US010743726B2

(12) United States Patent
Dieringer

(10) Patent No.: US 10,743,726 B2
(45) Date of Patent: Aug. 18, 2020

(54) FOLDED STACK OF TISSUES

(71) Applicant: Kimberly-Clark Worldwide, Inc., Neenah, WI (US)

(72) Inventor: Jessica Annette Ives Dieringer, Menasha, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 16/069,467

(22) PCT Filed: Jan. 25, 2016

(86) PCT No.: PCT/US2016/014721

§ 371 (c)(1),
(2) Date: Jul. 11, 2018

(87) PCT Pub. No.: WO2017/131611

PCT Pub. Date: Aug. 3, 2017

(65) Prior Publication Data

US 2019/0008334 A1 Jan. 10, 2019

(51) Int. Cl.
*A47K 10/42* (2006.01)
*A47K 10/20* (2006.01)
(Continued)

(52) U.S. Cl.
CPC ..... *A47K 10/421* (2013.01); *A47K 10/20* (2013.01); *A47K 10/42* (2013.01);
(Continued)

(58) Field of Classification Search
CPC ..... A47K 10/42; A47K 10/421; A47K 10/20; B65D 83/0805; B65D 83/0894
(Continued)

(56) References Cited

U.S. PATENT DOCUMENTS 1,657,942 A * 1/1928 Spaldo ..... B65D 83/0847 206/216
2,085,649 A * 6/1937 Gluck ..... B65D 83/0847 206/449
(Continued)

FOREIGN PATENT DOCUMENTS

EP 2336046 A1 6/2011
JP 2012120639 A * 6/2012
(Continued)

OTHER PUBLICATIONS

Co-pending U.S. Appl. No. 16/069,443, filed Jul. 11, 2018, by Dieringer et al. for "Folded Stack of Tissues."

*Primary Examiner* — Rakesh Kumar
(74) *Attorney, Agent, or Firm* — Kimerly-Clark Worldwide, Inc.

(57) ABSTRACT

The present invention provides a pack of tissues including multiple tissues arranged in a stack and a dispenser enclosing the stack. The dispenser includes a dispensing orifice. At least a portion of the tissues are folded so as to include a leading edge contacting the upper surface of a center panel and a trailing edge contacting the bottom surface of the center panel. The tissues are interfolded such as to have a portion of the leading edge of a first, or preceding, tissue to overlap the leading edge of a second, or succeeding tissue. In this manner, the leading edge of the first tissue terminates at a first vertical axis and the leading edge of the second tissue terminates at a second vertical axis where there is a distance between the first and the second vertical axis that is greater than 0.

10 Claims, 5 Drawing Sheets

(51) Int. Cl.
*B65D 83/08* (2006.01)
*B65H 45/24* (2006.01)
*A47K 10/32* (2006.01)

(52) U.S. Cl.
CPC ..... *B65D 83/0805* (2013.01); *B65D 83/0894* (2013.01); *B65H 45/24* (2013.01); *A47K 2010/3266* (2013.01); *A47K 2010/428* (2013.01)

(58) Field of Classification Search
USPC ..... 221/63, 48; 206/216, 409
See application file for complete search history.

(56) References Cited

U.S. PATENT DOCUMENTS 2,122,048 A * 6/1938 Shapiro ..... B65D 83/0805 206/494
3,209,941 A * 10/1965 Krake ..... A47K 10/421 221/48
3,215,332 A * 11/1965 Bess ..... B65D 5/542 229/240
3,456,843 A * 7/1969 Planner ..... A47K 10/423 221/63
3,456,844 A * 7/1969 Planner ..... B65D 83/0847 221/63
3,612,264 A * 10/1971 Trunick ..... B65D 83/08 206/449
3,624,791 A * 11/1971 Taub ..... A47K 10/421 221/59
3,896,966 A * 7/1975 Canno ..... B65D 83/0852 221/63
4,070,489 A * 1/1978 Pahnke ..... B65D 5/5253 206/45.2
4,793,487 A * 12/1988 Bentsen ..... B65D 33/001 206/451
5,269,423 A * 12/1993 Nguyen ..... B65D 83/0852 206/494
5,332,097 A * 7/1994 Wile ..... A47F 13/085 206/493
5,368,165 A * 11/1994 Ngyuen ..... B65D 33/001 206/494
5,405,021 A * 4/1995 Smithson ..... B65D 83/0811 206/554
5,497,903 A 3/1996 Yoneyama
5,509,527 A * 4/1996 Wang ..... A45C 11/34 206/214
5,520,308 A 5/1996 Berg
5,524,763 A * 6/1996 Wile ..... B65B 43/14 206/494
5,769,213 A * 6/1998 Chatterton ..... A45C 1/06 15/435
6,012,572 A 1/2000 Heathcock
6,109,430 A 8/2000 Bando
6,168,848 B1 1/2001 Heath
6,196,390 B1 3/2001 Bando
6,202,845 B1 3/2001 Hill
6,213,344 B1 4/2001 Hill
6,227,441 B1 5/2001 Sagel
6,286,712 B1 9/2001 Craig
6,548,135 B1 * 4/2003 Hershey ..... B01J 20/28023 2/49.1
6,550,634 B1 * 4/2003 Alegre De Miquel ..... A47K 10/421 221/48
6,644,501 B2 11/2003 Iida
6,964,349 B2 * 11/2005 Sears ..... A47K 10/421 206/494
7,028,860 B2 * 4/2006 Behnke ..... A47K 10/422 221/49
7,322,489 B2 * 1/2008 Long ..... B65H 45/24 221/38
7,571,832 B2 8/2009 Mark
7,784,675 B2 * 8/2010 Sutherland ..... B65D 5/5253 206/427
7,845,515 B2 12/2010 Moody
8,083,097 B2 * 12/2011 Kaufman ..... B65H 45/24 221/34
8,342,360 B2 1/2013 Long
8,640,870 B2 2/2014 Ruman
8,689,528 B1 4/2014 Gaspari
9,254,956 B2 * 2/2016 Markovic ..... B65D 5/5445
9,510,714 B2 12/2016 White
9,655,481 B2 * 5/2017 Mrvica ..... A61F 13/15747
2001/0020625 A1 * 9/2001 Angelis ..... A47K 10/421 221/45
2002/0060222 A1 * 5/2002 Bando ..... B65H 45/24 221/48
2003/0062376 A1 * 4/2003 Sears ..... B65H 45/24 221/48
2003/0116581 A1 6/2003 Schmidt
2006/0102643 A1 * 5/2006 Kaufman ..... B65H 45/24 221/48
2006/0219731 A1 * 10/2006 Long ..... B65H 45/24 221/48
2007/0215632 A1 * 9/2007 Bendor ..... A47K 10/42 221/63
2008/0041755 A1 2/2008 Noschang
2008/0041873 A1 2/2008 Baum
2010/0104799 A1 4/2010 Wunderlich
2013/0269893 A1 10/2013 Nelvig
2014/0001072 A1 1/2014 Christoffel
2014/0001196 A1 1/2014 Bushman
2014/0106117 A1 4/2014 Hochtritt
2015/0147521 A1 5/2015 Hochtritt
2015/0335210 A1 * 11/2015 Denis ..... B65D 83/0894 221/33
2019/0008334 A1 * 1/2019 Dieringer ..... B65H 45/24

FOREIGN PATENT DOCUMENTS

JP 5156486 B2 3/2013
JP 2014168693 A * 9/2014
JP 2014168693 A2 9/2014
KR 20030069225 A 8/2003
KR 101290109 B1 7/2013
KR 101535185 B1 * 7/2015

* cited by examiner

FOLDED STACK OF TISSUES

BACKGROUND OF THE DISCLOSURE

Some disposable sheet dispensers have been designed where the dispensing opening is a narrow slot or a slit. Such openings are well-suited to presenting tissue sheets for sequential removal. In some applications, however, it is sometimes difficult to remove the initial sheet from the stack when a narrow opening is present. For instance, the narrow opening can interfere with the ability of the user to grab the leading edge of the first sheet if the leading edge is located in a position that is not adjacent to the opening. Additionally the second sheet in the stack may be selected prior to the first sheet if its leading edge is in the vicinity of the opening resulting in a double sheet pull.

Another factor that is important in sheet dispensing is the height of the sheet that has been dispensed relative to the top surface of the package. Some sheet fold and interfold configurations present an exposed sheet that has an exposed sheet height which is too short which may result in sheet fallback into the package, increase the possibility of sheet tearing, or be too short to properly grasp it for proper dispensing. Alternately some sheet fold and interfold configurations present an exposed sheet that has an exposed sheet height which is too tall which may result in streaming or double pulls or too much of the sheet exposed to the elements. Streaming occurs when the user pulls the top sheet out, and the subsequent sheet or sheets are also withdrawn without the separation of the following sheet or sheets. In addition the appearance of the height of the exposed portion of the pulled sheet is preferred by consumers if it is in the range where it is not too short or too tall.

Another issue related to sheet folding and interfold configuration is package fill. For economy it is desirable for the stack of sheets to have the same thickness across the lateral width of the stack. That is, if there are one or more regions across the lateral direction of the stack that have fewer sheets it will result in concave unfilled regions which require additional packaging materials to enclose the stack. In addition the region with fewer sheets is less stiff, less stable and more likely to deform during use resulting in a package that may become misshapen. In an alternate configuration if there are one or more regions across the lateral direction of the stack that have more sheets it will result in convex overfilled regions which also require additional packaging materials to enclose the stack. The convex overfilled regions will also result in an unacceptable package presentation.

SUMMARY OF THE DISCLOSURE

The present invention now provides a folded stack of tissues having improved dispensing and more particularly a pop-up style dispensing that exposes only a portion of the sheet, such as less than half the sheet's width and more preferably less than about a quarter of the sheet's width and still more preferably less than a third of the sheet's width, compared to conventional fold patterns which expose about half the sheet's width when dispensed. This not only protects more of the sheet when dispensed, but also makes the tissue well suited for dispensing from containers with a reclosable orifice as less sheet is protruding from the container.

Another advantage of the present tissue product is that it provides a relatively compact stack of tissues having a substantially uniform stack height making it particularly well suited for dispensing from small or compact dispensers, such as dispensers containing fewer than about 50 tissue products, such as from about 10 to about 50, and having an upper surface area of less than about 250 $cm^2$ and more preferably less than about 220 $cm^2$.

Accordingly, in one aspect the present invention provides a pack of tissues including multiple tissues arranged in a stack and a dispenser enclosing the stack. The dispenser includes a dispensing orifice. At least a portion of the tissues in the stack are folded so as to include a leading edge contacting the upper surface of a center panel and a trailing edge contacting the bottom surface of the center panel. At least a portion of the tissues in the stack are interfolded such as to have a portion of the leading edge of a first, or preceding, tissue to overlap the leading edge of a second, or succeeding tissue. In this manner, the leading edge of the first tissue terminates at a first vertical axis and the leading edge of the second tissue terminates at a second vertical axis where there is a distance between the first and the second vertical axis that is greater than 0.

In another aspect the invention provides a stack of C-folded tissues interleaved with one another so as to provide a stack having a first end, a middle and a second end, where the stack height is substantially uniform between the first end, the middle and the second end. In such embodiments the number of folded sheets occurring at the first, middle and second ends is generally equal.

In still another aspect the invention provides a stack of folded tissues sheets comprising a plurality of C-folded tissue sheets, the first C-folded sheet has a first leading edge terminating at a first vertical axis and a first trailing edge and second C-folded tissue sheet having a second leading edge terminating at a second vertical axis and a second trailing edge, the first and the second C-folded tissues interleaved with one another such that the first and the second leading edges overlap and that the distance between the first and the second vertical axis is greater than 0.

In yet another aspect the invention provides a package of tissues comprising a dispenser having a dispensing orifice and a stack of tissues disposed within the external container, wherein the stack comprises a first C-folded tissue sheet having a first leading edge terminating at a first vertical axis and a first trailing edge and a second C-folded tissue sheet having a second leading edge terminating at a second vertical axis and a second trailing edge, the first and the second C-folded tissues interleaved with one another such that the first and the second leading edges overlap and wherein the distance between the first and the second vertical axis is greater than 0.

DETAILED DESCRIPTION OF THE DISLOSURE

Generally, the present invention is directed to the storage and dispensing of fibrous webs and more particularly tissue products. Tissue products useful in the present invention may include dry and wet wiping products and may comprise one or more fibrous webs or plies, where multiple plies are arranged in facing arrangement with one another. For storage and dispensing the tissue products may be folded, stacked and packaged in a dispensing container having an opening, slot or dispensing orifice in vertical alignment with the folded edges of the tissues. In some instances, the edges of tissue products within the stack are interleaved so that upon withdrawal of one tissue from the stack the edge of the next succeeding tissue is automatically brought through the dispensing opening so as to be readily available when it is desired to withdraw the next tissue.

Figure 1:
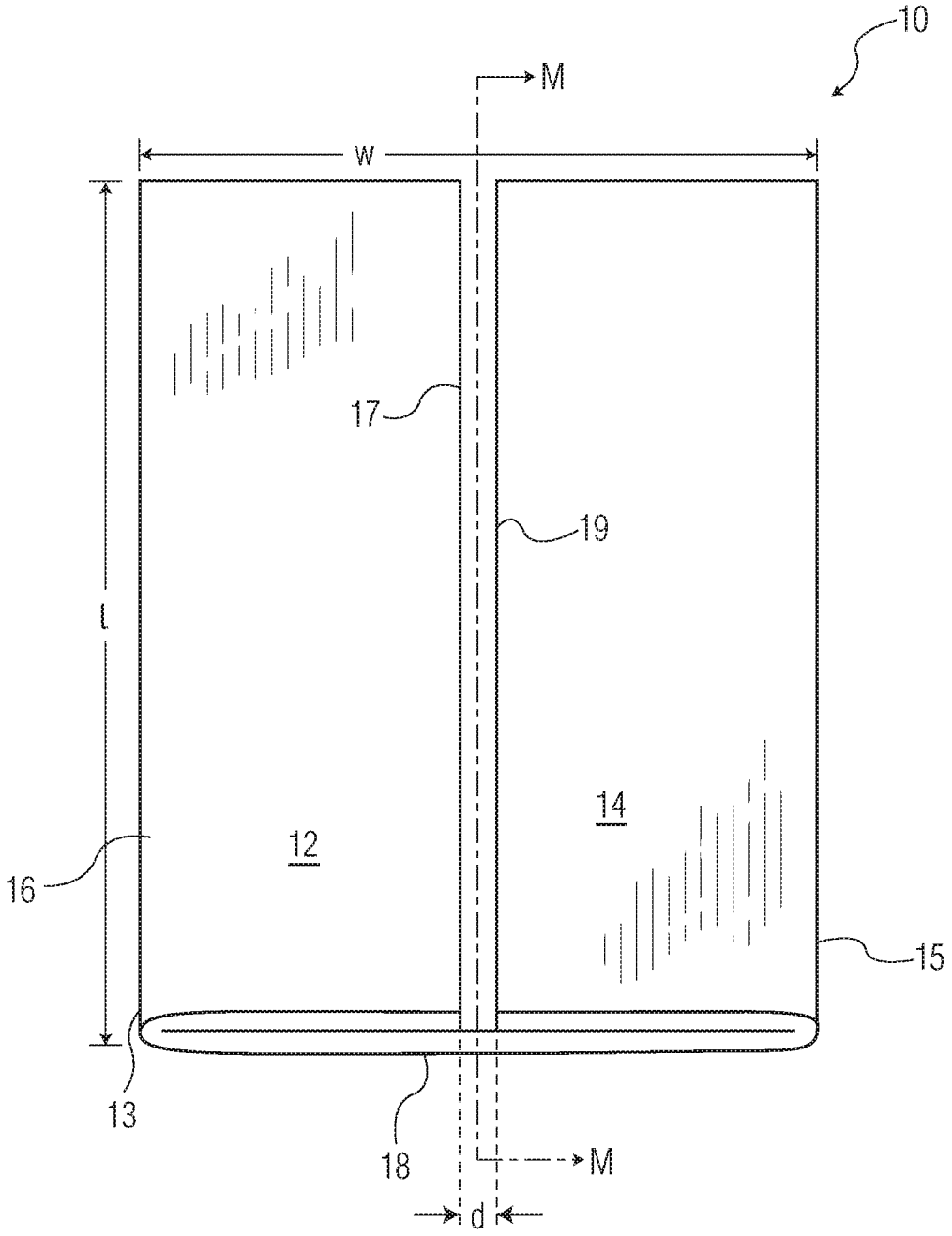
FIG. 1 is a perspective view of a single folded tissue according to one embodiment of the present invention.

Turning now to FIG. 1 there is shown a single folded tissue product 10 useful in the present invention. The single sheet employed for the tissue product 10 may be single-ply or may be multi-ply. The tissue product 10 may be any type of fibrous web and may comprise any known material for forming absorbent products such as towels, wipes, napkins, and the like. The illustrated product 10 is rectangular having a length (l) and a width (w), where the length (l) is greater than the width (w) when folded. Other shapes of folded tissue products are contemplated and the invention is not limited to rectangular shaped products. In the illustrated embodiment an individual tissue sheet is folded such that the sheet width is reduced by approximately half while the length is maintained. However, in other embodiments the length may be reduced by approximately half by folding while the width is maintained.

With further reference to FIG. 1, the folded tissue product 10 comprises a top surface and an opposed bottom surface. The product 10 has a length (l) and a width (w). The product 10 further comprises a pair of top panels 12, 14 and a bottom panel 18. The pair of top panels 12, 14 are created by folding the sheet along a first 13 and a second 15 fold line. The first top panel 12 is folded across the width (w) of the single sheet along the first fold line 13 to create a first leading edge 17. The second top panel 14 is folded across the width (w) of the single sheet along the second fold line 15 to create a second leading edge 19. When folded the bottom surface of the top panels 12, 14 are brought into contact with the upper surface of the bottom panel 18.

In the illustrated embodiment the width (w) of the folded product 10 is approximately half of the unfolded sheet and the first 17 and the second 19 leading edges are spaced apart from one another some distance (d). In a particularly preferred embodiment, such as that illustrated in FIG. 1, the top panels 12, 14 are folded such that the leading edges 17, 19 are folded towards the midpoint (M) of the bottom panel 18 lying equal distance from the midpoint. In this manner the width of each top panel 12, 14 is approximately equal and are less than half the width (w) of the folded product 10.

With further reference to FIG. 1, the top panels 12, 14 are positioned on the same surface of the tissue sheet such that they generally define the upper surface of the tissue product 10. In a particularly preferred embodiment the top panels 12, 14 are substantially equal in both width and length. For example, in one embodiment, the top panels 12, 14 are about 40 to about 48 percent of the width (w) of the folded product 10 and the first 17 and second 19 edges are spaced an equal distance (d) from the midpoint (M) of the center panel 14. In other embodiments the width of the top panels may be different and the distance between the first and second leading edges and the midpoint may not be equal.

The foregoing fold pattern is often referred to in the art as a C-fold pattern and results in a folded tissue sheet comprising a pair of leading edges providing a user with two different edges to dispense when pulling a tissue from a dispenser. The sheet is dispensed from the container with the second leading edge terminating the dispensing of the tissue.

For storage and dispensing, single tissue sheets may be stacked together to form a stack of tissues. A stack may comprise any number of tissues. For example, in certain embodiments the stack may comprise from about 5 to about 100 individual tissue products and more preferably from about 10 to about 50 and still more preferably from about 15 to about 40 tissue products. When referenced herein, the upper most tissue product in a stack is generally referred to as the nth tissue, while the subsequent abutting tissue in the stack is referred to as the n+1 tissue and so on.

Preferably all of the tissue products within a stack are folded. In certain preferred embodiments all of the sheets within a stack are folded in the same fold configuration. In other embodiments, the stack may comprise C-folded tissues as described here-in, as well as tissues folded in another configuration, such as S-folded, V-folded or Z-folded. For example, in one embodiment the nth through n+10 tissues are C-folded tissues and the n+11 through n+25 are folded in a different manner than the nth through n+10 tissues. While individual tissue products or even significant portions of the stack may be folded differently for improved dispensing, or to create a starter sheet(s), or for another purpose, in a particularly preferred embodiment at least the nth and n+1 tissues in a stack are C-folded as described herein.

Figure 2:
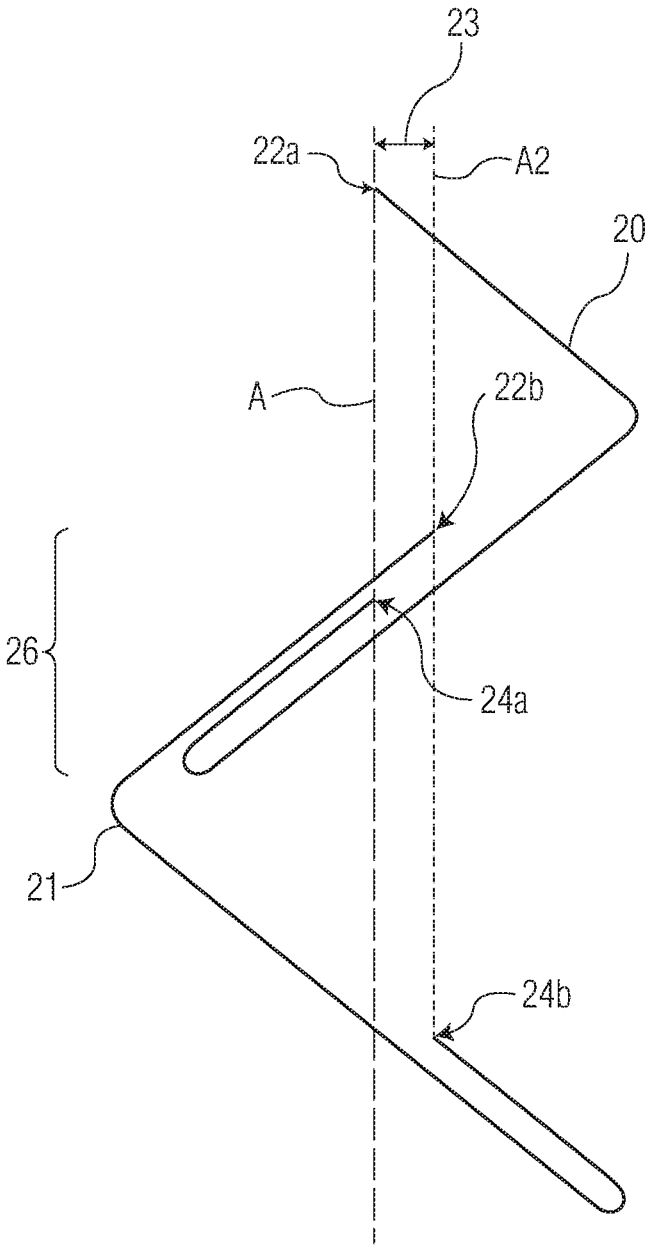
FIG. 2 is a perspective view of two interfolded tissues according to one embodiment of the present invention.

To ensure proper dispensing adjacent tissues are interleaved with one another. In this manner at least a portion of adjacent tissues overlap one another. When interleaved tissue sheets are packaged in a dispenser and the user removes the upper most tissue sheet from the stack the subsequent sheet will be exposed and have its upper edge available to be grasped by the user. Preferably adjacent sheets in a stack are interleaved with one another by overlapping the trailing edge of a first sheet with the leading edge of a second sheet. A particularly preferred interfolding pattern is illustrated in FIG. 2, which illustrates two interfolded tissues 20, 21. Each tissue 20, 21 has a leading 22*a*, 22*b* and a trailing 24*a*, 24*b* edge. The leading edge 22*b* of the second tissue 21 is placed over the trailing edge 24*a* of the first tissue 20 to create an overlap portion 26. Thus, the overlapping portion 26 may be defined as that portion of the tissue stack where first tissue 20 lies under the second tissue 21 and the two tissues contact one another. In this context "under" is used in reference to the spatial orientation relative to the first sheet to be dispensed from a stack or a pack of tissues.

While it is generally desirable to interleave adjacent sheets by overlapping them with one another, the present invention provides the nth and n+1 tissues C-folded and interfolded with one another such that the leading edges overlap one another. That is, for two interfolded tissues 20, 21 the first leading edge 22*a* terminates at a first vertical axis A and the second leading edge 22*b* terminates at a second vertical axis A2 where there is a distance 23 between A and A2, as referred to as an edge overlap 23. As further illustrated in FIG. 2, where the first 20 and second 21 tissues are similarly sized, overlapping the first 22*a* and second 22*b* leading edges to create an edge overlap 23 results in the first 24*a* and second 24 *b* trailing edges to not overlap one another.

Accordingly, in a particularly preferred embodiment, such as that illustrated in FIG. 2, the first leading edge 22*a* and the first trailing edge 24*a* both terminate at the first vertical axis (A) and the second leading edge 22*b* and the second trailing edge 24*b* terminate at the second vertical axis (A2). In this manner the leading edges 22*a*, 22*b* overlap one another to form an edge overlap 23, but the trailing edges 24*a*, 24*b* do not overlap one another.

Figure 3:
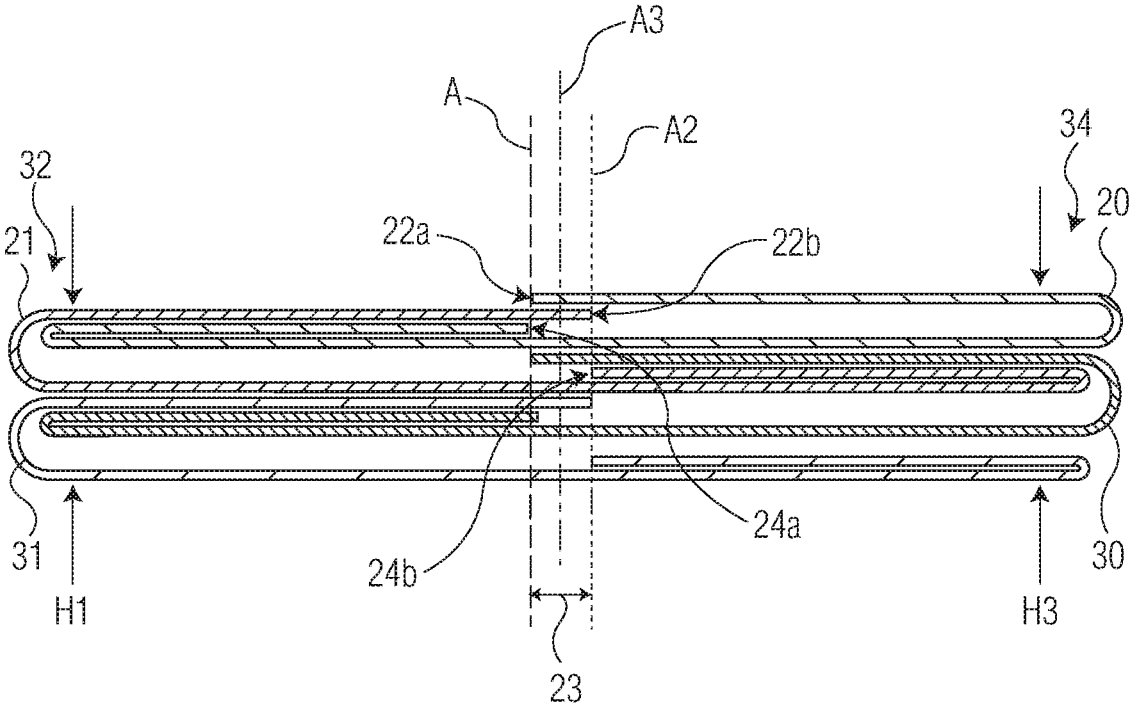
FIG. 3 is a cross-sectional view of a stack of tissues according to one embodiment of the present invention.

The fold and interfolding patterns of the present invention are shown in more detail in the stack of tissues 26 illustrated in FIG. 3. The stack of tissues 26 comprises four C-folded tissue products 20, 21, 30 and 31 (also referred to as the nth, n+1, n+2 and n+3 tissues). Now with reference to the two upper most tissues 20, 21 in the stack 26, the nth and n+1 tissues, each tissue has a leading edge 22*a*, 22*b* and a trailing edge 24*a*, 24*b*. The tissues are interfolded such that the leading edge 22*a* terminates at a first vertical axis A and the second leading edge 22*b* terminates at a second vertical axis A2 thereby forming an edge overlap 23. Further, the first trailing edge 24*a* terminates at a first vertical axis A and the second trailing edge 24*b* terminates at a second vertical axis A2 such that the trailing edges do not overlap. This interfolding pattern is repeated for the n+2 and n+3 tissues 30, 31 in the stack 26. In this manner the leading edge of one tissue is offset or overlaps with the leading edge of the adjacent tissue and the edge overlap is substantially uniform throughout the stack of tissues.

Although the edge overlap is substantially equal throughout the illustrated stack, the invention is not so limited. For example, the edge overlap may vary between the two upper most tissues in a stack compared to the bottom two tissues. In other embodiments the upper most tissues in a stack, such as the nth through n+10 tissues may have an edge overlap, while the bottom most tissues in the stack, such as the n+11 through n+24 tissues may not have an edge overlap.

The distance between the leading edges of adjacent tissue sheets in a stack, i.e., the edge overlap, may vary depending on the width of the folded tissue product, as well as the type of dispenser, the dispensing orifice and other factors. In certain embodiments, a tissue sheet having dimensions of 208×213 mm may be C-folded into a folded tissue product having dimensions of 208×106.5 mm and two such folded tissue products may be interleaved such that their leading edges form an edge overlap of about 2 to about 20 mm and more preferably from about 5 to about 10 mm. All distances are measured when the tissue sheets are folded, stacked and have not been dispensed.

With further reference to FIG. 3, all the sheets 20, 21, 30, 31 are C-folded and the sheets are interfolded such that the leading edges of adjacent sheets overlap one another. While it may be advantageous to have all of the sheets in a stack folded in a similar manner and for all adjacent sheets to have leading edges which are spaced apart from one another, the invention is not so limited. It is however, desirable to have the uppermost sheets in a stack to be C-folded and interleaved such that adjacent sheets have leading edges which are spaced apart from one another.

While not wishing to be bound by theory, folding and interfolding tissue sheets in this manner improves dispensing and provides a stack 26 having first 32 and second 34 ends comprising the same number of sheets and the stack 26 having a stack height that is substantially equally when measured near the first and second ends and in the middle of the stack. Conversely, overlapping the leading edges of adjacent sheets would result in the stack having a convex region located in the area where the edges overlapped. In other embodiments, the invention provides a stack 26 of tissues having a first end 32 having a first height (H1), generally measured about 1 cm from the first end of the tissue stack, the midpoint of the stack having a second height and a second end having a third height (H3), generally measured about 1 cm from the second end 34 of the tissue stack opposite of the first end 32, where the first, second and third heights are substantially equal.

One skilled in the art will appreciate that stack height is the vertical measurement, taken from a horizontal reference plane, of the plurality of tissues sheets as it lays unrestrained on the horizontal reference surface. It is to be recognized that the same size and number of tissues comprising the plurality may have different heights depending upon the folding pattern, the caliper of the tissues, interleaved pattern, etc., used to place one tissue in proximity to the next tissue in the plurality. In those embodiments where the first, second and third heights are substantially equal there may be slight variations in the heights, such as less than about 5 percent and more preferably less than about 2 percent.

Each individual tissue within the stack is C-folded, however, the invention is not so limited as discussed above. In addition to the illustrated C-folded tissue products the stack may comprise tissue products that are Z-folded, S-folded or V-folded. However, where the upper most folded tissue in a stack, i.e., the tissue closest to the dispensing orifice prior to any tissues being dispensed from the stack, is designated as the nth tissue and the next tissue lying thereunder is the n+1 tissue, it is desirable that both the nth and the n+1 tissue are C-folded. Further, as illustrated in FIG. 3, the nth and the n+1 tissue are interfolded such that leading edge 22*a* of the nth tissue 20 overlays the leading edge 22*b* of the n+1 tissue 21 and the leading edges 22*a*, 22*b* overlap such there is an overlap distance 23. This interfold may be repeated for subsequent tissues in the stack. In one particularly preferred embodiment all of the tissue products are C-folded and are interfolded according to the foregoing pattern. In this manner the resulting stack of folded and interfolded tissue products has an equal number of sheets in each position along the width of the stack.

In other embodiments the surface area of the overlapping edge area of two adjacent tissues in the stack is different than the surface area of the overlapping edge area of two other adjacent tissues in the stack. For example, the nth and n+1 tissues may have an edge overlap having a first area, while the n+2 and n+3 may have an edge overlap having a second area, where the first and second areas are different. The difference in the area of the overlap may be created by differences in width of the overlapping edges (illustrated as 23 in FIG. 3). Width and length of the overlapping portion are generally defined in regard to, and measured parallel to, the width and length of the folded tissue product. The surface area is measured, or can be mathematically calculated, from the width and length.

In one embodiment all of the tissues in a stack have the same overlap area, such as an overlap area of at least about 4 $cm^2$ and more preferably from about 10 to about 45 $cm^2$ and still more preferably from about 10 to about 20 $cm^2$. In another embodiment the nth and n+1 tissues have an overlap area from about 10 to about 20 $cm^2$, while the n+23 and n+24 tissues have an overlap area from about 10 to about 20 $cm^2$.

Stacks of interfolded tissues are generally stored and dispensed from a dispenser. Suitable dispensers are well known in the art and may include both flexible and rigid dispensers. The tissue stack disclosed herein is particularly well suited for dispensing from flexible dispensers and more particularly small flexible dispensers having a generally rectangular shape with a length less than about 25 cm, such as from about 10 to about 25 cm and a width less than about 15 cm, such as from about 10 to about 15 cm. Flexible dispensers may comprise polypropylene, nylon or other flexible polymeric material.

Regardless of its construction, the dispenser comprises a dispensing orifice and in certain embodiments may comprise a lid covering the dispensing orifice. The lid may be disposable or may be resealable. The dispensing orifice through which the enclosed tissues are dispensed from the carton can have a variety of forms and dimensions. For example, the orifice shape may be round, square, ovoid, triangular or rectangular. In other embodiments the orifice may be a simple slit having a relatively small width relative to its length. Regardless of the specific shape of the orifice, the orifice will generally have a length and a width. The length is the maximum dimension of the dispensing orifice in a direction that is substantially parallel to the leading edge of a tissue to be dispensed. The width of the orifice is the maximum dimension of the orifice in a direction orthogonal to the length of the orifices.

In a particularly preferred embodiment the orifice is a simple slit having a length that is substantially parallel to the length of the tissue stack disposed within the dispenser. The length of the slit is generally measured as the distance between a first end of the slit and the second end of the slit. The slit may have a length that is equal to the length of the stack of tissues, less than the length of the stack of tissue or greater than length of the stack of tissues. For example, in one embodiment the length of the orifice is less than the length of the stack of tissues, such as about 70 to about 98 percent of the length of the stack of tissues.

The dispenser generally may be made from any suitable material and may be either rigid or flexible. Particularly preferred dispensers are those formed from flexible materials. For example, in one embodiment, the dispenser may comprise a flexible packet produced from a continuous wall of film which is formed into discrete packets having fin seals along the center bottom of the packet and end seals. The seals can be effected either sonically or thermally as desired. Suitable materials for forming flexible dispensers are well known in the art and include polypropylene, polyethylene, PVA, EVA and nylon. As used herein the term "flexible" it is meant that the film out of which the dispenser is constructed will offer minimal resistance to bending and will tend to conform or deform in the presence of externally applied forces.

Figure 4:
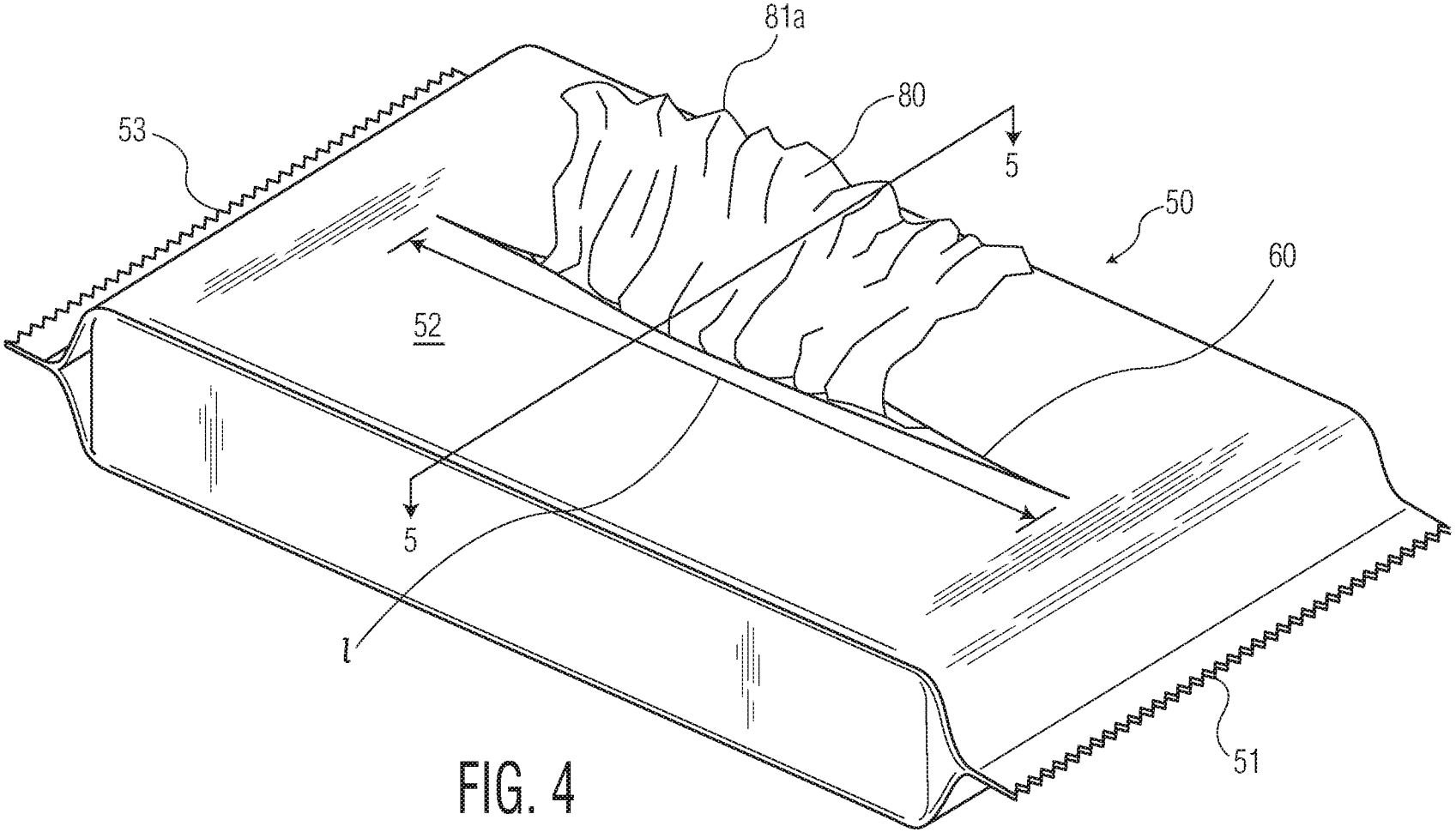
FIG. 4 is a perspective view of a tissue package according to one embodiment of the present invention.

One embodiment of a dispenser useful in the present invention is illustrated in FIG. 4. The package of tissues 50 comprises a flexible wrapper overwrapping a stack of tissues and sealed at two ends 51, 53. The package 50 comprises a top surface 52 having a dispensing orifice 60 disposed thereon. The dispensing orifice 60 is illustrated as being a simple slit, although other shapes and configurations are contemplated. The orifice 60 has a length (l) and a width, which is generally created by withdrawing the tissue from the dispenser in use and may vary along the length (l) of the orifice 60. A tissue product 80 having a leading edge 81*a* is illustrated as being partially dispensed from the dispenser 50 through the orifice 60.

Figure 5:
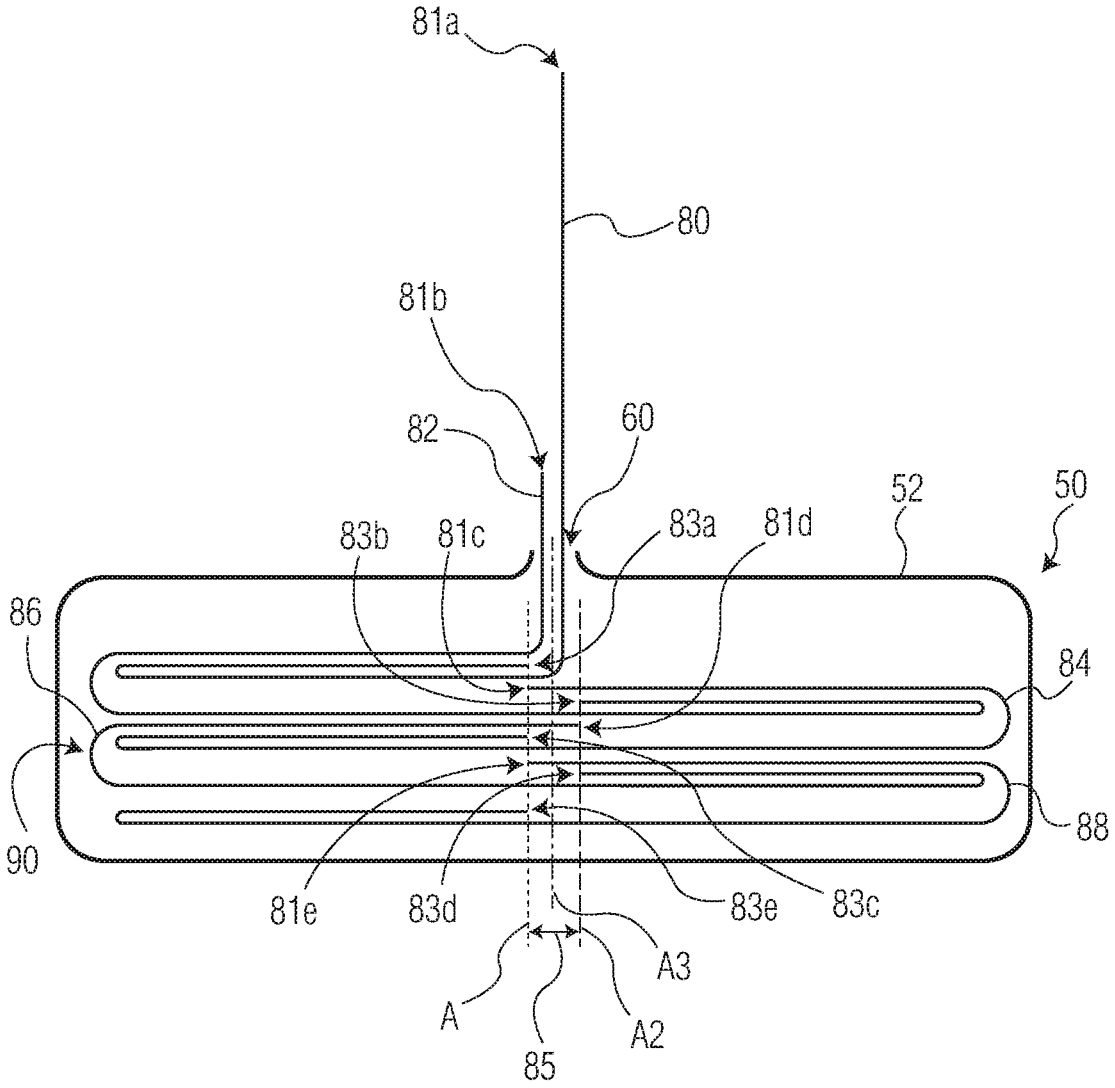
FIG. 5 is a cross-section view of the package illustrated in FIG. 4 through line 5-5.

Turning now to FIG. 5, which is a cross sectional view of the dispenser 50 of FIG. 4 through the line 5-5, a stack 90 of five C-folded tissues 80, 82, 84, 86 and 88 are illustrated. The upper most tissue 80 in the stack 90 is illustrated as being partially dispensed through the orifice 60 centered about a vertical axis A3. A sufficient amount of the first sheet 80 has been dispensed such that a portion of the second sheet 82 has been dispensed through the orifice 80. The overlapping of the leading edges of two adjacent C-folded sheets, as described above, facilitates dispensing in this manner.

Once the first two sheets 80, 82 are dispensed the leading edge 81*c* of the third sheet 84 (the n+2 sheet) will lie adjacent to the orifice 60 vertical axis A3 and will be presented through the orifice 60 to be grasped by a user and dispensed. When the n+2 sheet 84 is sufficiently dispensed the leading edge 81*d* of the n+3 sheet 86 will be drawn through the orifice 60 and will be partially dispensed for use by the user.

With further reference to FIG. 5, in the illustrated embodiment, the tissues sheets are folded and interleaved such that the leading edge (e.g., 81*c*) of each tissue crosses the vertical axis A3. For example, the leading edge 81*c* of the n+2 tissue 84 crosses and extends to the right hand side of the axis A3 while the leading edge 81*d* of the n+3 tissue 86 crosses and extends to the left hand side of the axis A3. While this alternating pattern of leading edges extending beyond the central axis may by desirable, the invention is not so limited. In certain embodiments only some of the tissues in a stack may be folded and interleaved so as to have this alternating pattern.

Regardless of whether all or only a few of the sheets are folded and interleaved so as to have the foregoing alternating pattern, it is generally desirable for the leading edge of the sheet to be disposed some distance away from the vertical axis defining the midpoint of the orifice's width. However, the leading edge should not be so far removed from the orifice's central vertical axis so as to be out of reach of a user in use. Thus, in certain embodiments, it may be desirable to arrange the leading edge of the tissue such that the vertical axis defining the leading edge (shown in FIG. 5 as A) is within about 20 mm of the orifice's central vertical axis (shown in FIG. 5 as A3), more preferably from about 5 to about 10 mm away. This geometry provides a sheet with the trailing edge of that sheet closer to the orifice than the leading edge of that sheet prior to dispensing.

While various folded, stacked and packaged tissue products have been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto and the foregoing embodiments.

In a first embodiment the present invention provides a stack of interleaved tissue sheets comprising a first C-folded tissue sheet having a first leading edge terminating at a first vertical axis and a first trailing edge, and a second C-folded tissue sheet having a second leading edge terminating at a second vertical axis and a second trailing edge, wherein the first and the second C-folded tissues are interleaved with one another such that the first and the second leading edges overlap such that the distance between the first and the second vertical axis is greater than 0.

In a second embodiment the present invention provides the stack of the first embodiment wherein the distance between the first and the second vertical axis is from about 2 to about 20 mm.

In a third embodiment the present invention provides the stack of the first or the second embodiments wherein the first and the second C-folded tissue sheets comprising a tissue sheet having a length and a width, a first top panel folded along a first fold line and terminating at the first leading edge, and a second top panel folded along a second fold line and terminating at a second leading edge, wherein the first and the second top panels have substantially equal widths. In certain embodiments the distance between the first and the second vertical axis is from about 5 to about 10 mm.

In a fourth embodiment the present invention provides the stack of any one of the first through the third embodiments wherein the first trailing edge terminates at the first vertical axis and the second trailing edges terminates at the second vertical axis.

In a fifth embodiment the present invention provides the stack of any one of the first through the fourth embodiments wherein the stack has a first end, a middle and a second end, wherein the first end, the middle and the second end comprise an equal number of tissue sheets.

In a sixth embodiment the present invention provides the stack of any one of the first through the fifth embodiments wherein the stack has a first end, a middle and a second end and wherein the stack height of the first end, the middle and the second end is substantially equal.

In a seventh embodiment the present invention provides the stack of any one of the first through the sixth embodiments further comprising interleaved folded tissues sheets wherein the tissue sheets are V-, Z- or S-folded.

In an eighth embodiment the present invention provides the stack of any one of the first through the seventh embodiments further comprising a third tissue sheet having a third leading edge and a fourth sheet having a fourth leading edge wherein the third leading edge and the fourth leading edge overlap one another.

In a ninth embodiment the present invention provides a package of tissues comprising a dispenser having a dispensing orifice and a stack of tissues disposed within the package, wherein the stack comprises a first C-folded tissue sheet having a first leading edge terminating at a first vertical axis and a first trailing edge and a second C-folded tissue sheet having a second leading edge terminating at a second vertical axis and a second trailing edge, the first and the second C-folded tissues interleaved with one another such that the first and the second leading edges overlap one another and wherein the distance between the first and the second vertical axis is greater than 0.

In a tenth embodiment the present invention provides the pack of tissues of the ninth embodiment wherein the stack of tissues has a width and a length and the dispensing orifice has a length, the length of the dispensing orifice being orientated parallel to the length of the stack of tissues and having a length that is from about 90 to about 98 percent of the length of the stack of tissues.

What is claimed is:

1. A stack of interleaved tissue sheets comprising:

a. a first C-folded tissue sheet having a first folded top panel having a folded edge and a first leading edge terminating at a first vertical axis and a second folded top panel having a folded edge and a first trailing edge, wherein the first and second folded top panels do not overlap one another, b. a second C-folded tissue sheet having a third folded top panel having a folded edge and a second leading edge terminating at a second vertical axis and a fourth folded panel having a folded edge and a second trailing edge, wherein the third and fourth top panels do not overlap one another, c. a third tissue sheet having a third leading edge terminating at the first vertical axis, and d. a fourth sheet having a fourth leading edge terminating at the second vertical axis, wherein the first and the second C-folded tissues are interleaved with one another such that the first and the second leading edges overlap such that the distance between the first and the second vertical axis is greater than 0 and wherein the third leading edge and the fourth leading edge overlap one another.

2. The stack of interleaved tissue sheets of claim 1 wherein the distance between the first and the second vertical axis is from about 2 to about 20 mm.

3. The stack of interleaved tissue sheets of claim 1 wherein the first and the second C-folded tissue sheets comprising a tissue sheet having a length and a width, a first top panel folded along a first fold line and terminating at the first leading edge, and a second top panel folded along a second fold line and terminating at a second leading edge, and wherein the first and the second top panels have substantially equal widths the first, second, third and fourth top panels have a width approximately half of the C-folded tissue width.

4. The stack of interleaved tissue sheets of claim 3 wherein the distance between the first and the second vertical axis is from about 5 to about 10 mm.

5. The stack of interleaved tissue sheets of claim 1 wherein the first trailing edge terminates at the first vertical axis and the second trailing edges terminates at the second vertical axis.

6. The stack of interleaved tissue sheets of claim 1 wherein the stack has a first end, a middle and a second end, wherein the first end, the middle and the second end comprise an equal number of tissue sheets.

7. The stack of interleaved tissue sheets of claim 1 wherein the stack has a first end, a middle and a second end and wherein the stack height of the first end, the middle and the second end is substantially equal.

8. The stack of interleaved tissue sheets of claim 1 further comprising interleaved folded tissues sheets wherein the tissue sheets are V-, Z- or S-folded.

9. The stack of interleaved tissue sheets of claim 1 wherein the third sheet has a third leading edge terminating at the first vertical axis and the fourth sheet has a fourth leading edge terminating at the second vertical axis.

10. The stack of interleaved tissue sheets of claim 1 wherein the third and the fourth tissue sheets are C-folded sheets having a pair of top panels, each top panel having a folded edge, a leading edge and a trialing edge, wherein the pair of top panels do not overlap one another.

* * * * *